US005564694A

United States Patent [19]

Bowman

[11] Patent Number: 5,564,694

[45] Date of Patent: Oct. 15, 1996

[54] BASKETBALL RING MOUNT

[76] Inventor: Trevor Bowman, 16 Olympus Drive, St. Clair NSW 2759, Australia

[21] Appl. No.: 331,321

[22] Filed: Oct. 28, 1994

[30] Foreign Application Priority Data

Nov. 8, 1993 [AU] Australia ..... PM5669

[51] Int. Cl.[6] ..... A63B 63/08

[52] U.S. Cl. ..... 273/1.5 R; 248/628

[58] Field of Search ..... 273/1.5 R, 1.5 A; 248/628, 548, 573, 610; 172/707, 708, 711, 264

[56] References Cited

U.S. PATENT DOCUMENTS

| | | | |
|---|---|---|---|
| 31,571 | 2/1861 | Crandall | 248/628 X |
| 67,153 | 7/1867 | Ashe | 248/628 X |
| 200,147 | 2/1878 | Merrill | 248/628 X |
| 3,462,143 | 8/1969 | Bidelman et al. | 273/1.5 R |
| 4,285,518 | 8/1981 | Pearo | 273/1.5 R |
| 4,441,709 | 4/1984 | Schroeder et al. | 273/1.5 R |
| 5,071,120 | 12/1991 | Dadbeh | 273/1.5 R |
| 5,114,141 | 5/1992 | Mahoney | 273/1.5 R |

FOREIGN PATENT DOCUMENTS

| | | | |
|---|---|---|---|
| 323051 | 12/1929 | United Kingdom | 248/628 |

*Primary Examiner*—Paul E. Shapiro

*Attorney, Agent, or Firm*—Cohen, Pontani, Lieberman, Pavane

[57] ABSTRACT

A basketball ring incorporating a U-shaped flat spring steel component between the mount and the ring in order to protect the ring from deformation; the rate of the spring being less than that required for deformation of the ring under the influence of a downwardly directed force.

7 Claims, 1 Drawing Sheet

BASKETBALL RING MOUNT

DISCUSSION OF RELATED ART

The present invention relates to basketball rings and in particular to a flexible mount for use in conjunction with basketball rings.

In order that the game of basketball may be played correctly a basketball ring must be mounted in a horizontal plane and the front of the ring must not dip significantly out of such plane.

Sometimes during the playing of a basketball game the contact between a player and the ring will result in bending of the mount or ring such that the ring is no longer mounted horizontally. More frequently however basketball rings are subjected to abuse at times other than during the playing of a basketball game or practice as persons may jump up and hang from the ring in order to show off to friends, do pullups or generally just vandalise the ring.

The lastmentioned difficulty has become considerably more pronounced in recent years to the extent where schools particularly are having to expend significant sums of money in order to maintain basketball rings in good condition.

It is therefore the object of the present invention to avoid the abovementioned vulnerability of prior art basketball rings or at least to provide the market with a better choice.

SUMMARY OF THE INVENTION

According to the present invention there is provided a mount for a basketball ring having a first surface adapted to directly or indirectly locate a basketball ring and a second surface adapted to facilitate fixing of the mount to a support surface; a section of flat spring steel interposed between said first and second surfaces and having a spring rate such that it will deform from its normal playing position under the influence of a force exerted on the ring in a downward direction the force being less than that required to create permanent deformation of the ring and/or any other support apparatus for the ring.

BRIEF DESCRIPTION OF THE DRAWING

FIG. I. depicts an improved basketball ring mount in accordance with a preferred embodiment of the present invention.

DETAILED DESCRIPTION OF THE PREFERRED EMBODIMENT

Figure 1:
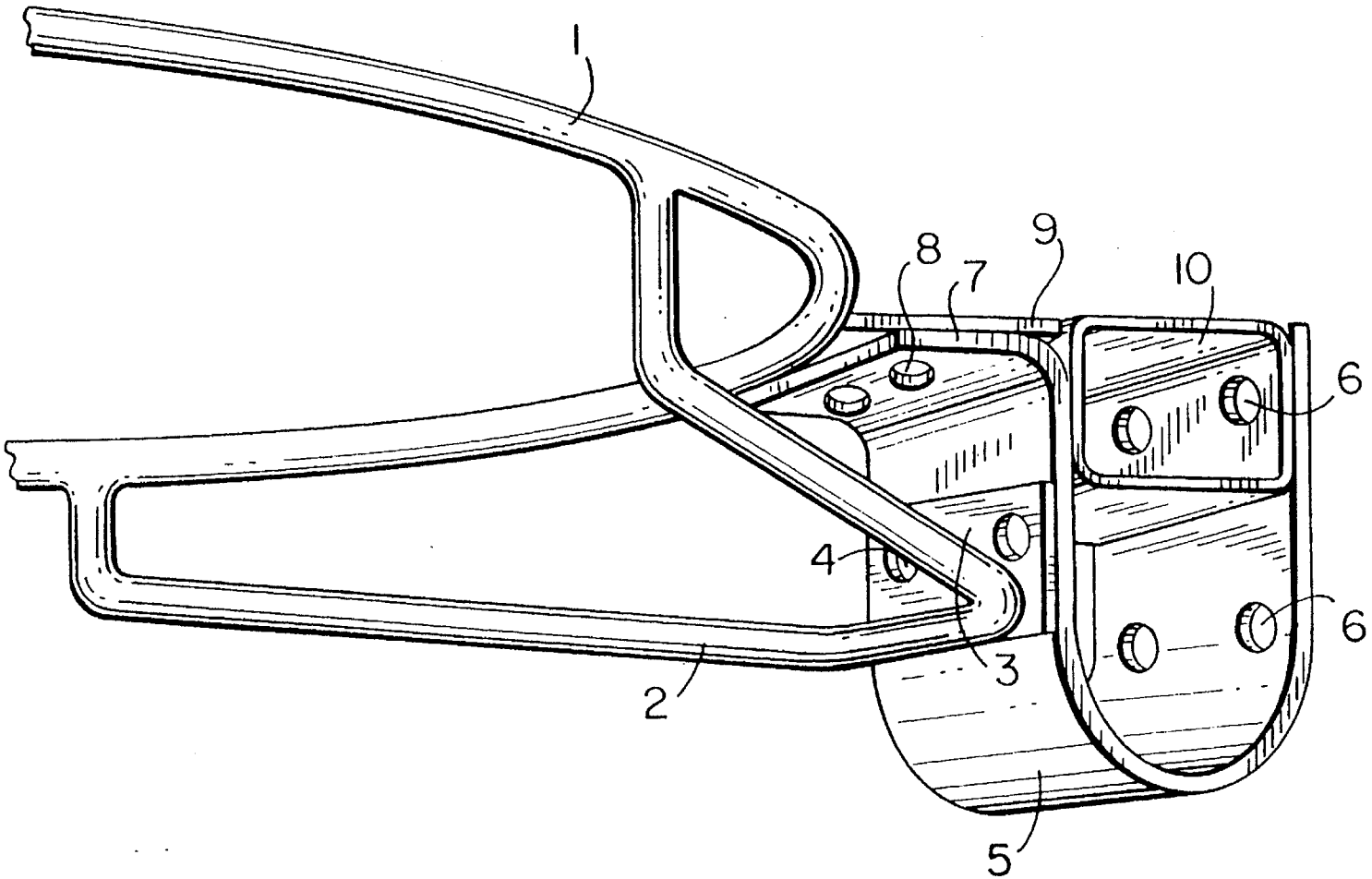

One embodiment of the present invention will now be described with reference to FIG. I herein being a perspective view of a mount in accordance with the present invention attached to a basketball ring.

According to the embodiment of FIG. I there is provided a basketball ring 1 fabricated from steel in the conventional way and having an integral brace 2. Brace 2 is welded to plate 3 which in turn is bolted through holes 4 to U-shaped member 5 fabricated from flat spring steel. The rear of U-shaped spring steel member 5 is provided with holes 6 through which the member may be bolted to a support surface such as a backboard or wall.

The forward extremity of spring steel U-shaped member 5 terminates in a horizontal extension 7 adapted to be bolted through holes 8 to plate 9 which plate 9 is welded to the back of ring 1.

U-shaped spring steel member 5 is initialy fabricated so that its upper extremities are considerably closer together than that position depicted at FIG. I. When these upper extremities are forced apart by spacer member 10 so that the member adopts a true U-shape with parrallel vertical sides the spring steel member 5 is therefore subject to significant preload. In the embodiment of FIG. I spacer member 10 is fabricated from rectangular channel section steel and is permanently affixed to the rear of the U-shaped spring steel member 5 although not to the forward upper portions of member 5.

The fact that U-shaped spring steel member 5 is subject to a preload has two advantages. Firstly downward forces exerted on ring 1 have to achieve some significant magnitude before the ring will deflect out of the horizontal position. In this case a 600 Newton preload has been selected.

Secondly the fact that spacer member 10 restrains spring steel member 5 in a playing position which is not its true unstressed equilibrium position greatly reduces the tendency of the spring member to oscillate about its equilibrium position once a deflecting force is removed. The basketball ring will therefore quickly return to its horizontal playing position after deformation without executing ever decreasing displacements about the equilibrium position. Spacer member 10 therefore eliminates the necessity for elaborate damping mechanisms.

Preload is measured by application of the force to the ring at the furthest point of the ring from the backboard and all preload measurements referred to in this specification are measured in accordance with the same procedure. A force of 600 Newtons has been selected as this is considered appropriate for schools. Basketball rules may require that the ring does not deflect unless a force of over 1,000 Newtons is applied whereas in primary schools the preload of the spring steel member may need to be as low as 400 Newtons in order to discourage children from hanging from the ring.

It is essential that spring steel member 5 be designed so that it will deflect under the influence of a downward force on the ring which is less than the force required to permanently deform either the ring, support braces 2 or indeed any other hardware associated with mounting of the ring.

It should be appreciated that a number of changes may be made to the embodiment of FIG. I without departing from the scope and intendment of the present invention. For example ring 1 may be welded directly to the forward upper extremity of U-shaped member 5 thereby making plate 9 redundant and similarly plate 3 may be made redundant by welding brace 2 directly to member 5.

Although the U-shape of spring steel member 5 is considered to have much merit it is similarly not essential that the spring steel member be of U-shaped configuration. Many other shapes may be devised and subjected to preloads so as to achieve the objects of the present invention.

I claim:

1. A mount for a basketball ring comprising: a first surface adapted to locate a basketball ring; a second surface adapted to facilitate fixing of the mount to a support; a section of flat spring steel having a preload and interposed between said first and second surfaces and having a spring rate such that said section deforms from its normal playing position under the influence of a force exerted on the ring in a downward direction, the force being less than that required to create permanent deformation of the ring and support, said section being of a substantially U-shaped configuration having a rear leg and a forward leg, said rear leg being adapted to be affixed to said support and said forward leg being adapted to locate a basketball ring; said section being fabricated so that at its equilibrium position each leg converges towards its opposing leg and in its playing position, with the opened end of the U uppermost a spacer attached to one of the legs, the legs are urged apart into a substantially parallel relationship, thereby effecting the preload.

2. A mount in accordance with claim 1, wherein the pre-load is greater than 400 Newtons.

3. A mount for a basketball ring comprising:

a first surface adapted to locate a basketball ring;

a second surface adapted to facilitate fixing of the mount to a support; a section having a preload and interposed between said first and second surfaces and having a spring rate such that said section deforms from its normal playing position under the influence of a force exerted on the ring in a downward direction, the force being less than that required to create permanent deformation of the ring and support, said section being of a substantially U-shaped configuration having a rear leg and a forward leg, said rear leg being adapted to be affixed to said support and said forward leg being adapted to locate a basketball ring, said section being fabricated so that at its equilibrium position each leg converges towards its opposing leg and in its playing position, with the opened end of the U uppermost a spacer attached to one of the legs, the legs are urged apart, thereby effecting the preload.

4. A mount in accordance with claim 3, wherein the pre-load is greater than 400 Newtons.

5. A mount for a basketball ring comprising:

a first surface adapted to locate a basketball ring;

a second surface adapted to facilitate fixing of the mount to a support; a section interposed between said first and second surfaces and having a spring rate such that said section deforms from its normal playing position under the influence of a force exerted on the ring in a downward direction, the force being less than that required to create permanent deformation of the ring and support, said section being of a substantially U-shaped configuration having a rear leg and a forward leg, said rear leg being adapted to be affixed to said support and said forward leg being adapted to locate a basketball ring, said section being fabricated so that at its equilibrium position each leg converges towards its opposing leg and in its playing position, with the opened end of the U uppermost a spacer attached to one of the legs, the legs are urged apart.

6. The mount of claim 5, wherein said section is subject to a preload.

7. The mount of claim 6, wherein said preload is greater than 400 Newtons.

* * * * *